US010144220B2

(12) United States Patent
Fukuda

(10) Patent No.: US 10,144,220 B2
(45) Date of Patent: Dec. 4, 2018

(54) LIQUID EJECTING HEAD

(71) Applicant: Seiko Epson Corporation, Tokyo (JP)

(72) Inventor: Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 17 days.

(21) Appl. No.: 15/533,330

(22) PCT Filed: Dec. 7, 2015

(86) PCT No.: PCT/JP2015/006072
§ 371 (c)(1),
(2) Date: Jun. 5, 2017

(87) PCT Pub. No.: WO2016/103594
PCT Pub. Date: Jun. 30, 2016

(65) Prior Publication Data

US 2018/0001641 A1 Jan. 4, 2018

(30) Foreign Application Priority Data

Dec. 22, 2014 (JP) ..... 2014-258686

(51) Int. Cl.
*B41J 2/14* (2006.01)
*B41J 2/145* (2006.01)
*B41J 2/15* (2006.01)

(52) U.S. Cl.
CPC ..... *B41J 2/15* (2013.01); *B41J 2/1433* (2013.01); *B41J 2/14233* (2013.01); *B41J 2002/14241* (2013.01)

(58) Field of Classification Search
CPC ..... B41J 2/14233; B41J 2/14; B41J 2002/14241; B41J 2202/11; B41J 2/14201;
(Continued)

(56) References Cited

U.S. PATENT DOCUMENTS 9,527,282 B2 * 12/2016 Fukuda ..... B41J 2/14201
2012/0281044 A1 11/2012 Andrews et al.
(Continued)

FOREIGN PATENT DOCUMENTS

CN 103963466 A 8/2014
DE 4424771 C1 11/1995
(Continued)

*Primary Examiner* — Huan H Tran
(74) *Attorney, Agent, or Firm* — Workman Nydegger

(57) ABSTRACT

A liquid ejecting head includes a pressure chamber substrate on which a plurality of spaces as pressure chambers are formed along a first direction; a nozzle substrate on which a plurality of nozzles which eject liquid are formed by corresponding to the pressure chamber; and a flow path substrate on which a plurality of communicating holes which communicate with the nozzle and the pressure chamber which corresponds to the nozzle are formed between the pressure chamber substrate and the nozzle substrate, in which both ends of each pressure chamber in a second direction are formed by being aligned at a predetermined position in the second direction, the nozzles which are adjacent in the first direction are formed so that positions thereof in the second direction are different, and the communicating holes which are adjacent in the first direction are formed so that positions in the second direction are different.

9 Claims, 4 Drawing Sheets

(58) Field of Classification Search
CPC ..... B41J 2002/14419; B41J 2/14274; B41J 2002/14306; B41J 2/045
See application file for complete search history.

(56) References Cited

U.S. PATENT DOCUMENTS

| | | | |
|---|---|---|---|
| 2014/0218441 | A1 | 8/2014 | Nakao |
| 2014/0267498 | A1 | 9/2014 | Shuhei et al. |
| 2014/0292944 | A1 | 10/2014 | Junhua |

FOREIGN PATENT DOCUMENTS

| | | | |
|---|---|---|---|
| EP | 1552930 | A2 | 7/2005 |
| EP | 2623322 | A1 | 8/2013 |
| JP | 2005-034997 | A | 10/2005 |

* cited by examiner

[Fig. 1]
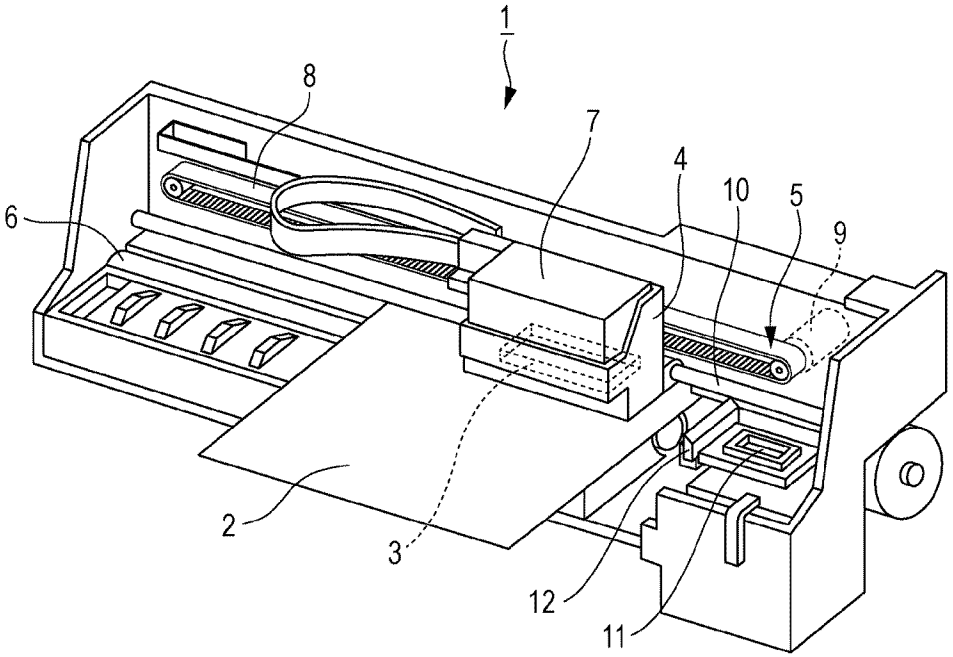

[Fig. 2]
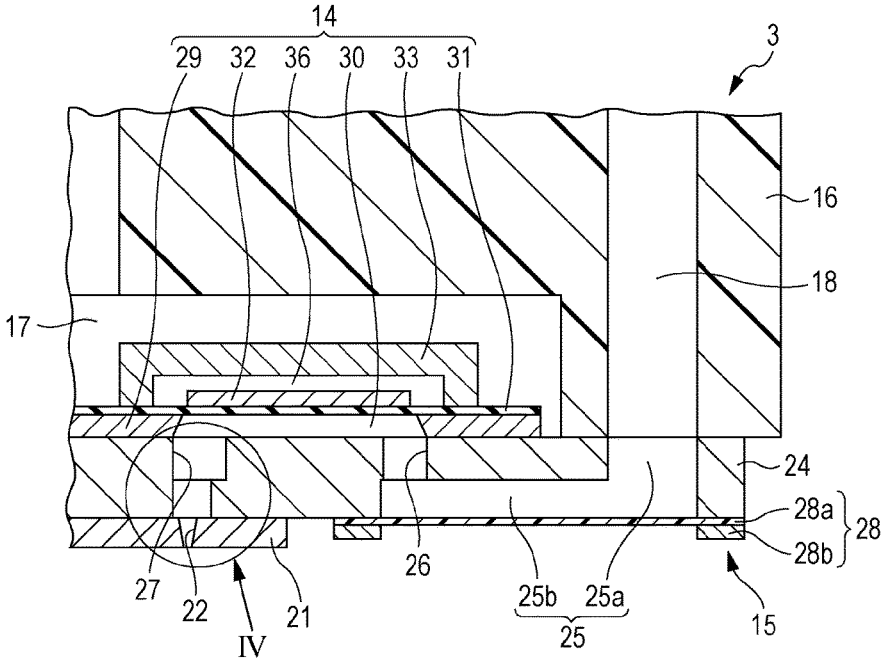
[Fig. 3]
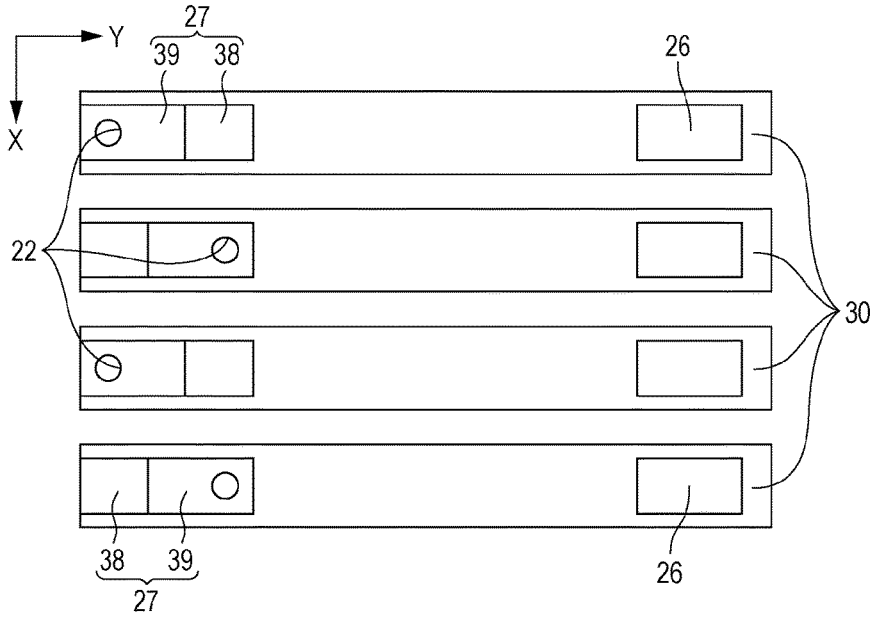

[Fig. 4]
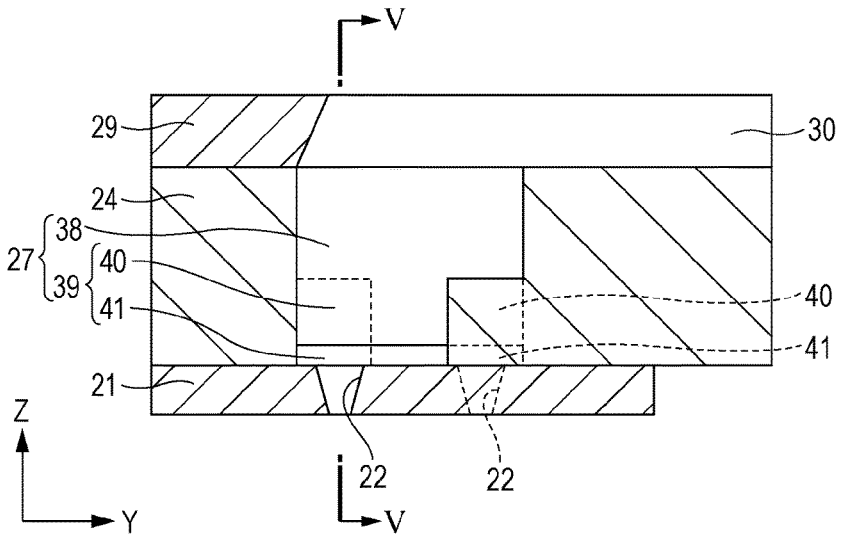
[Fig. 5]
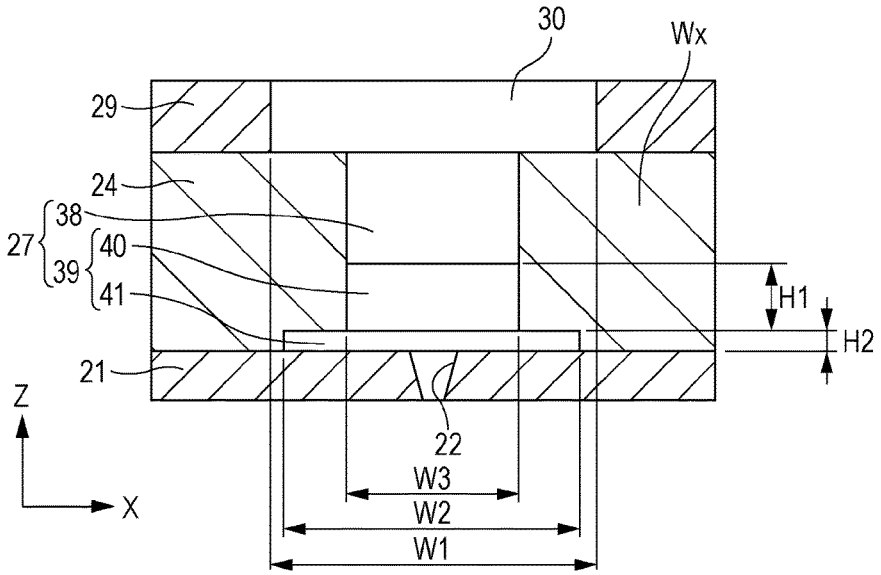

[Fig. 6]
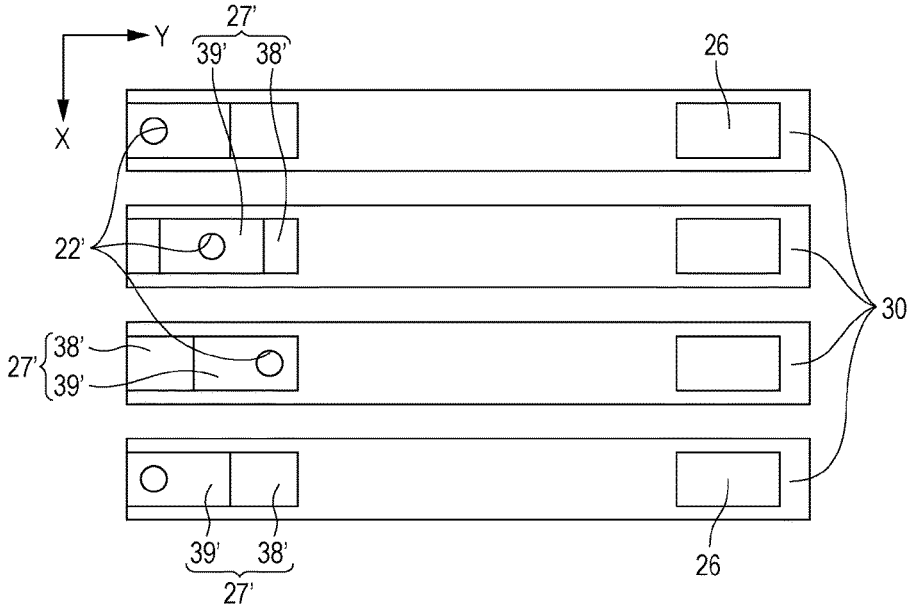
[Fig. 7]
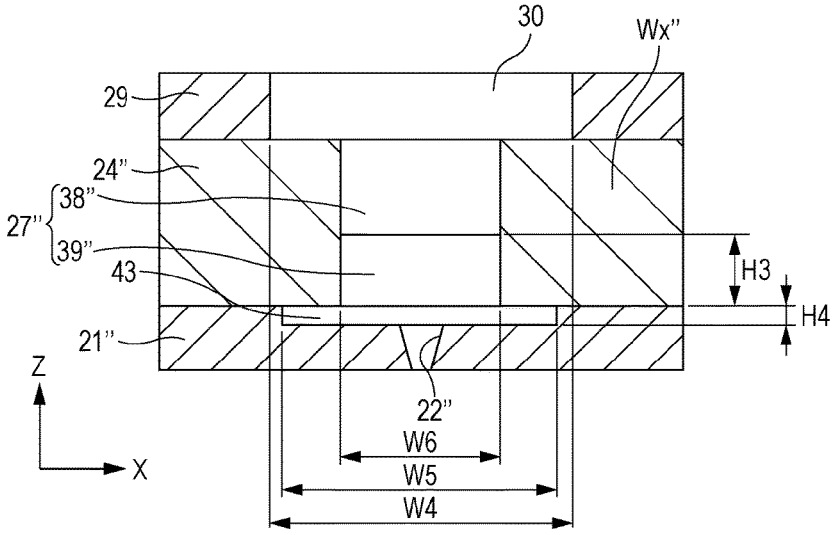

LIQUID EJECTING HEAD

TECHNICAL FIELD

The present invention relates to a liquid ejecting head such as an ink jet recording head which ejects liquid in a pressure chamber from nozzles by causing a pressure change in the pressure chamber which communicates with the nozzles.

BACKGROUND ART

The liquid ejecting head is used in an image recording apparatus such as an ink jet printer or an ink jet plotter, for example; however, in recent years, the liquid ejecting head is also applied to various manufacturing devices by making the best use of an advantage that it is possible to cause minute amounts of liquid to land on a predetermined position. For example, the liquid ejecting head is applied to a display manufacturing device which manufactures a color filter of a liquid crystal display, or the like, an electrode forming device which forms an electrode of an organic electroluminescence (EL) display, a surface light emitting display (FED), or the like, and a chip manufacturing device which manufactures a biochip (biotip). In addition, liquid ink is ejected from a recording head for the image recording apparatus, and a solution of each coloring material of R (red), G (green), and B (blue) is ejected from a coloring material ejecting head for the display manufacturing device. In addition, a liquid electrode material is ejected from an electrode material ejecting head for the electrode forming device, and a solution of a bioorganic material is ejected from a bioorganic material ejecting head for the chip manufacturing device.

The above described liquid ejecting head includes a plurality of nozzles, a pressure chamber which is formed in each nozzle, a communicating hole which communicates with the nozzle and the pressure chamber, and a piezoelectric element (a type of actuator) which causes a pressure change in liquid in each pressure chamber. Here, the communicating hole also functions as a buffer against a change in properties of liquid which is caused when liquid in the liquid ejecting head is thickened, or ingredients in liquid have settled. For this reason, a volume, that is, a liquid volume is secured by raising a height thereof compared to a height of the pressure chamber. However, when the height of the communicating hole is raised, the rigidity of a partitioning wall which partitions communicating holes which are adjacent to each other therebetween tends to be lowered. As a result, a phenomenon in which ejecting of liquid from a nozzle, or the like, has an influence on ejecting of liquid from an adjacent nozzle, that is, so-called crosstalk easily occurs.

Therefore, a technology in which positions of adjacent nozzles and the communicating holes corresponding to the nozzles are arranged so as to be different from each other in the longitudinal direction has been proposed, in order to improve the rigidity of a portioning wall between communicating holes (for example, refer to PTL 1). In this case, the dimension of each pressure chamber in the longitudinal direction of the pressure chamber is set to be the same in a viewpoint of making ejecting properties of liquid from each nozzle uniform. For this reason, positions of adjacent pressures chamber are set to be different from each other in the longitudinal direction by corresponding to the communicating holes.

CITATION LIST

Patent Literature

PTL 1: JP-A-2005-34997

SUMMARY OF INVENTION

Technical Problem

However, when positions of adjacent pressure chambers are arranged so as to be different from each other in the longitudinal direction, since a substrate on which the pressure chambers are formed becomes large in the longitudinal direction in response thereto, it is disadvantageous when reducing the size of a liquid ejecting head.

The present invention is made in consideration of such circumstances, and accordingly, it is an object of the present invention to provide a liquid ejecting head which can be reduced in size.

Solution to Problem

In order to achieve the above described object, according to the invention, there is provided a liquid ejecting head including a pressure chamber substrate on which a plurality of spaces as pressure chambers are formed along a first direction; a nozzle substrate on which a plurality of nozzles which eject liquid in the pressure chamber are formed by corresponding to the pressure chamber; and a flow path substrate on which a plurality of communicating holes which communicate with the nozzle and the pressure chamber which corresponds to the nozzle are formed between the pressure chamber substrate and the nozzle substrate, in which both ends of each pressure chamber in a second direction which is orthogonal to the first direction are formed by being aligned at a predetermined position in the second direction, the nozzles which are adjacent to each other in the first direction are formed so that positions thereof in the second direction are different from each other, and at least part of the communicating holes which are adjacent to each other in the first direction are formed so that positions in the second direction are different by corresponding to the nozzles.

According to the configuration, since both ends of each pressure chamber in the second direction are aligned at predetermined positions, it is possible to make the pressure chamber substrate small, and to make the liquid ejecting head small. In addition, since positions of nozzles which are adjacent to each other are arranged so as to be different from each other in the second direction, it is possible to suppress a phenomenon in which an irregular air current (turbulent flow) which is generated when liquid droplets are ejected from each nozzle at the same time has an influence on a landing position, that is, the occurrence of so-called wind ripple. In addition, since at least part of communicating holes which are adjacent to each other are arranged so that positions thereof are different in the second direction, it is possible to increase the rigidity of a partitioning wall which partitions communicating holes which are adjacent to each other therebetween, and to suppress a phenomenon in which ejecting of liquid from a nozzle, or the like, has an influence on ejecting of liquid from a nozzle which is adjacent thereto, that is, so-called crosstalk.

In the configuration, it is preferable that a supply port from which liquid is supplied to the pressure chamber is formed on the flow path substrate.

According to the configuration, it is possible to further reduce the size of the pressure chamber substrate.

In the configuration, it is preferable that the communicating hole includes a first space which is formed on the pressure chamber side, and a second space which is formed on the nozzle side, both ends of each first space in the second direction are formed by being aligned at predetermined positions in the second direction, and the second spaces which are adjacent to each other in the first direction are formed so that positions in the second direction are different from each other.

According to the configuration, it is possible to secure a liquid volume of the communicating hole using the first space while suppressing crosstalk.

In the configuration, it is preferable that an end on one side of the first space in the second direction is formed at the same position as an end on the same side of the pressure chamber, or an outward position of the pressure chamber from an end of the pressure chamber.

According to the configuration, it is possible to make liquid smoothly flow toward the communicating hole from the pressure chamber, and to suppress stagnation of air bubbles. In addition, since it is possible to use the pressure chamber up to an end on one side as a space in which effective pressure is generated, efficiency of liquid ejecting is improved.

In the configuration, it is preferable that the second space includes a first small space which is formed on the pressure chamber side, and a second small space which is formed on the nozzle side, a dimension of the first small space in the first direction is smaller than a dimension of the pressure chamber in the first direction, and a dimension of the second small space in the first direction is larger than a dimension of the first small space in the first direction.

According to the configuration, it is possible to suppress an increase in a flow path resistance in the vicinity of the nozzle while increasing the rigidity of the partitioning wall which partitions communicating holes which are adjacent to each other therebetween. In this manner, it is possible to suppress variation in the ejecting direction of liquid droplets which are ejected from the nozzle while suppressing crosstalk.

In the configuration, it is preferable that a dimension of the second small space in a direction orthogonal to the nozzle substrate is smaller than a dimension of the first small space in the direction orthogonal to the nozzle substrate.

According to the configuration, it is possible to sufficiently secure the rigidity of the partitioning wall which partitions communicating holes which are adjacent to each other therebetween.

In the configuration, it is preferable that a recessed space which communicates with the second space is formed in a region corresponding to the second space of the nozzle substrate, and the nozzle is open in the recessed space, and a dimension of the recessed space in the first direction is larger than the dimension of the second space in the first direction.

According to the configuration, it is possible to suppress a decrease in flow path resistance in the vicinity of the nozzle while securing the rigidity of the partitioning wall of the communicating hole. In this manner, it is possible to suppress variation in ejecting direction of liquid droplets which are ejected from the nozzle while suppressing crosstalk.

In the configuration, it is preferable that both side walls of the second space in the second direction extend in a direction orthogonal to the nozzle substrate, and the nozzle is arranged by being shifted to a side wall side in the second direction on a side opposite to a side of the nozzles which are adjacent to each other in the first direction with respect to the second space.

According to the configuration, it is possible to widen an interval between nozzles which are adjacent to each other in the first direction, and to further suppress the occurrence of wind ripple. In addition, since both side walls of the second space in the second direction extend in a direction orthogonal to the nozzle substrate, it is possible to suppress stagnation of air bubbles in the second space.

In the configuration, it is preferable that the flow path substrate is a silicon substrate, and the communicating hole is formed on the flow path substrate using etching.

According to the configuration, it is possible to form the communicating hole with high accuracy, and with ease.

BRIEF DESCRIPTION OF DRAWINGS

FIG. 1 is a perspective view which describes a configuration of a printer.

FIG. 2 is a sectional view of a recording head which goes along a longitudinal direction of a pressure chamber.

FIG. 3 is a plan view of the recording head which is viewed from a higher part of a pressure chamber substrate.

FIG. 4 is an enlarged view of a region IV in FIG. 2.

FIG. 5 is a sectional view which is cut along line V-V in FIG. 4.

FIG. 6 is a plan view of a recording head according to a second embodiment which is viewed from a higher part of a pressure chamber substrate.

FIG. 7 is a sectional view of main parts of a recording head according to a third embodiment which goes along an arranging direction of a pressure chamber.

DESCRIPTION OF EMBODIMENTS

Hereinafter, embodiments of the invention will be described with reference to accompanying drawings. In addition, the embodiments which will be described below are variously limited as preferable specific examples of the invention; however, the scope of the invention is not limited to the embodiments as long as there is no description which particularly limits the invention in the following descriptions. In addition, in the following descriptions, an ink jet printer (hereinafter, referred to as printer) which is a type of a liquid ejecting apparatus on which an ink jet recording head (hereinafter, referred to as recording head) which is a type of a liquid ejecting head of the invention is mounted will be described as an example.

A configuration of a printer 1 will be described with reference to FIG. 1. The printer 1 is an apparatus which performs recording of an image, or the like, by ejecting ink (a type of liquid) on the surface of a recording medium 2 (a type of landing target) such as a recording sheet. The printer 1 includes a recording head 3, a carriage 4 to which the recording head 3 is attached, a carriage moving mechanism 5 which moves the carriage 4 in the main scanning direction, a transport mechanism 6 which transports the recording medium 2 in the sub-scanning direction, and the like. Here, the ink is stored in an ink cartridge 7 as a liquid supply source. The ink cartridge 7 is detachably mounted on the recording head 3. In addition, it is also possible to adopt a configuration in which an ink cartridge is arranged on a main body side of a printer, and ink is supplied to a recording head through an ink supply tube from the ink cartridge.

The carriage moving mechanism 5 includes a timing belt 8. In addition, the timing belt 8 is driven by a pulse motor 9 such as a DC motor. Accordingly, when the pulse motor 9 is operated, the carriage 4 is guided to a guide rod 10 which is built in the printer 1, and performs a reciprocating movement in the main scanning direction (width direction of recording medium 2). A position of the carriage 4 in the main scanning direction is detected by a linear encoder (not illustrated) which is a type of position detecting unit. The linear encoder transmits a detection signal thereof, that is, an encoder pulse (a type of position information) to a control unit of the printer 1.

In addition, a home position which is a base point of scanning of the carriage 4 is set in a region in an end portion on the outer side of a recording region in a movement range of the carriage 4. A cap 11 which seals a nozzle 22 which is formed on a nozzle face (nozzle substrate 21) of the recording head 3, and a wiping unit 12 for wiping the nozzle face are arranged in order from the end portion side.

Subsequently, the recording head 3 will be described. FIG. 2 is a sectional view of the recording head 3 which goes along the longitudinal direction of a pressure chamber 30. FIG. 3 is a plan view of the recording head 3 which is viewed from a higher part of a pressure chamber substrate 29. FIG. 4 is an enlarged view of a region IV in FIG. 2. FIG. 5 is a sectional view which is cut along line V-V in FIG. 4, that is, a sectional view of the recording head 3 which goes along an arranging direction of the pressure chamber. As illustrated in FIG. 2, the recording head 3 according to the embodiment is attached to a head case 16 in a state in which an actuator unit 14 and a flow path unit 15 are stacked. In addition, according to the embodiment, two columns of the pressure chamber 30 are formed; however, in FIG. 2, a configuration corresponding to one column of the pressure chamber 30 is omitted. In addition, for convenience, a stacking direction of each member will be described as a vertical direction.

The head case 16 is a box-shaped member which is made of a synthetic resin, and in which a reservoir 18 which supplies ink to each pressure chamber 30 is formed therein. The reservoir 18 is a space in which ink common to the plurality of pressure chambers 30 which are provided in parallel is stored, and two reservoirs are formed by corresponding to columns of the pressure chamber 30 which are provided in parallel in two columns. According to the embodiment, reservoirs 18 are respectively formed on both sides in which an accommodating space 17 is interposed therebetween in a direction (hereinafter, referred to as second direction Y) which is orthogonal to the arranging direction of the pressure chamber 30 (hereinafter, referred to as first direction X). In addition, an ink introducing path (not illustrated) on which ink from the ink cartridge 7 side is introduced to the reservoir 18 is formed at a higher part of the head case 16. In addition, the accommodating space 17 which is recessed in a rectangular parallelepiped shape is formed on the lower face side of the head case 16 from the lower face to a midway point in the height direction of the head case 16. When the flow path unit 15 is bonded to a lower face of the head case 16 in a state of being positioned, the actuator unit 14 which is bonded onto the flow path unit 15 is accommodated in the accommodating space 17.

The flow path unit 15 which is bonded to the lower face of the head case 16 includes a flow path substrate 24, a nozzle substrate 21, and a compliance sheet 28. The flow path substrate 24 is a plate material made of silicon, and is manufactured using a silicon single crystal substrate in which the surface (higher face and lower face) is set to (110) face, in the embodiment. As illustrated in FIG. 2, in the flow path substrate 24, a common liquid chamber 25 which communicates with the reservoir 18, and in which ink common to each pressure chamber 30 is stored, a supply port 26 through which ink from the reservoir 18 is individually supplied to each pressure chamber 30 through the common liquid chamber 25, and a communicating hole 27 which communicates with each pressure chamber 30 and a nozzle 22 which corresponds thereto are formed using etching.

The common liquid chamber 25 is a long hollow portion which extends the first direction X (that is, arranging direction of pressure chamber 30), and is formed in two columns by corresponding to two reservoirs 18. The common liquid chamber 25 is configured of a first liquid chamber 25*a* which penetrates the flow path substrate 24 in the plate thickness direction, and a second liquid chamber 25*b* which is recessed up to a midway point of the flow path substrate 24 in the plate thickness direction toward the top face side from the lower face side of the flow path substrate 24, and is formed in a state of leaving a thin plate portion on the top face side. A plurality of the supply ports 26 are formed along the first direction X by corresponding to the pressure chamber 30 in the thin plate portion of the second liquid chamber 25*b*. As illustrated in FIG. 3, the supply port 26 communicates with an end portion on the other side (side opposite to communicating hole 27) in the second direction Y (that is, longitudinal direction of pressure chamber 30) of a corresponding pressure chamber 30, in a state in which the flow path substrate 24 and the pressure chamber substrate 29 are bonded in a state of being positioned.

The communicating hole 27 is formed by penetrating a position of the flow path substrate 24 corresponding to each nozzle 22 in the plate thickness direction. That is, the communicating hole 27 communicates with the nozzle 22 and the pressure chamber 30 corresponding thereto between the pressure chamber substrate 29 and the nozzle substrate 21. The plurality of communicating holes 27 are formed along the first direction X by corresponding to the column of the pressure chamber 30. As illustrated in FIG. 3, the communicating hole 27 communicates with an end portion on one side (side opposite to supply port 26) of a corresponding pressure chamber 30 in the second direction Y in a state in which the flow path substrate 24 and the pressure chamber substrate 29 are bonded by being positioned. In addition, positions of the lower portions of the communicating hole 27 (second space 39 which will be described later) which are adjacent to each other in the first direction X in the second direction Y are formed so as to be different. In addition, the configuration of the communicating hole 27 will be described later in detail.

The nozzle substrate 21 is a silicon substrate (for example, silicon single crystal substrate) which is bonded to the lower face (face on a side opposite to pressure chamber substrate 29) of the flow path substrate 24. The nozzle substrate 21 according to the embodiment is bonded to a region which is separated from the common liquid chamber 25 in the flow path substrate 24. The plurality of nozzles 22 are open in a linear shape (column shape) along the first direction X in the nozzle substrate 21. According to the embodiment, two nozzle columns are provided in parallel in a state of being deviated from each other by a half pitch (parallel pitch of pressure chamber 30) at a pitch of two times of an arranging pitch (that is, pitch corresponding to dot forming density) of the pressure chamber 30 by corresponding to a column of one pressure chamber 30. That is, four nozzle columns are formed by corresponding to two columns of the pressure chamber 30. As illustrated in FIG. 3, the two nozzle columns corresponding to one column of the pressure chamber 30 are respectively arranged at a position which is shifted to one side (left side in FIG. 3) in the second direction Y, and a position which is shifted to the other side (right side in FIG. 3) with respect to the communicating hole 27. In other words, the nozzles 22 which correspond to pressure chambers 30 which are adjacent to each other in the second direction Y are arranged so that positions thereof in the second direction Y are different from each other. It is possible to suppress the occurrence of a phenomenon in which an irregular air current (turbulent flow), which is generated when ink droplets are simultaneously ejected from each nozzle 22, has an influence on a landing position, that is, the occurrence of so-called wind ripple. In addition, an opening position, or the like, of the nozzle 22 will be described later in detail along with a configuration of the communicating hole 27.

The compliance sheet 28 is a region which is separated from a region to which the nozzle substrate 21 of the flow path substrate 24 is bonded, and is bonded to a region corresponding to the common liquid chamber 25 in a state of clogging an opening of the common liquid chamber 25 on the lower face side. The compliance sheet 28 is formed of a flexible film 28*a* with flexibility, and a hard fixing plate 28*b* with a top face onto which the flexible film 28*a* is fixed. An opening is provided at a position of the fixing plate 28*b* corresponding to the common liquid chamber 25 so that flexible deformation of the flexible film 28*a* is not hindered. In this manner, the lower face side of the common liquid chamber 25 becomes a compliance unit which is partitioned only by the flexible film 28*a*. It is possible to absorb a pressure change which occurs in the reservoir 18 and ink in the common liquid chamber 25 using the compliance unit.

The actuator unit 14 is set as a unit by being stacked with the pressure chamber substrate 29, a vibrating plate 31, a piezoelectric element 32, and a sealing plate 33. The actuator unit 14 is formed so as to be smaller than the accommodating space 17 so as to be accommodated in the accommodating space 17.

The pressure chamber substrate 29 is a silicon plate material, and is manufactured using a silicon single crystal substrate in which the surface (higher face and lower face) is set to (110) face, in the embodiment. A plurality of spaces which become the pressure chamber 30 are provided in parallel by corresponding to each nozzle 22 in the pressure chamber substrate 29. The pressure chamber 30 is a hollow portion which is long in the second direction Y which is orthogonal to the first direction X, in which the communicating hole 27 communicates with an end portion on one side in the second direction Y (that is, longitudinal direction of pressure chamber 30), and the supply port 26 communicates with an end portion on the other side. According to the embodiment, two columns of the space which becomes the pressure chamber 30 are formed. In addition, columns of each pressure chamber 30 are linearly arranged in parallel along the first direction X. That is, as illustrated in FIG. 3, both ends of each pressure chamber 30 in the second direction Y in the same column are formed by being aligned at a predetermined position in the second direction Y. Here, the end of the pressure chamber 30 means the outermost end of the lower side of the pressure chamber 30 (flow path substrate 24 side). For example, as in the embodiment, when a side face of the pressure chamber 30 is inclined toward the lower part, a lower end of the inclination becomes the end of the pressure chamber 30. In addition, as illustrated in FIG. 3, since the pressure chamber 30 according to the embodiment is formed in a rectangular shape in a planar view, both side faces in the second direction Y become the end of the pressure chamber 30. In addition, for example, when the both side faces of the pressure chamber in the second direction Y is obliquely formed in a planar view, that is, when the pressure chamber is formed as a parallelogram, or the like, an apex on the outermost side becomes the end of the pressure chamber.

The vibrating plate 31 is stacked on the top face of the pressure chamber substrate 29 (face on a side opposite to flow path substrate 24 side), and seals a higher part opening of the space which becomes the pressure chamber 30. That is, the pressure chamber 30 is partitioned using the vibrating plate 31. The vibrating plate 31 is configured of an elastic film formed of silicon dioxide ($SiO_2$) which is formed on a top face of the pressure chamber substrate 29, and an insulating film formed of zirconium oxide ($ZrO_2$) which is formed on the elastic film. In addition, the piezoelectric elements 32 are respectively stacked in a region corresponding to each of the pressure chambers 30 on the insulating film (that is, face on a side opposite to the pressure chamber substrate 29 side of the vibrating plate 31).

The piezoelectric element 32 according to the embodiment is a piezoelectric element 32 of a so-called flexural mode. The piezoelectric element 32 is formed by being stacked on the vibrating plate 31 in order of a lower electrode layer, a piezoelectric layer, and a higher electrode layer (none of them is illustrated). The piezoelectric element 32 which is configured in this manner is deformed in a flexural manner in the vertical direction when an electric field corresponding to a potential difference in both electrodes between the lower electrode layer and the higher electrode layer is applied. According to the embodiment, two columns of the piezoelectric element 32 are formed by corresponding to two columns of the pressure chamber 30. In addition, the lower electrode layer and the higher electrode layer are extended from the columns of the pressure chamber 30 on both sides to a region between the columns, and are connected to a flexible cable which is not illustrated.

The sealing plate 33 is stacked on the vibrating plate 31 so as to cover the two columns of the piezoelectric element 32. A long piezoelectric accommodating space 36 which can accommodate the columns of the piezoelectric element 32 is formed in the sealing plate 33. The piezoelectric accommodating space 36 is a recessed portion which is formed from the lower face side (vibrating plate 31 side) to a midway point of the sealing plate 33 in the height direction, toward the top face side (head case 16 side) of the sealing plate 33. According to the embodiment, since columns of the piezoelectric element 32 which are provided in parallel are two columns, the piezoelectric accommodating space 36 is formed in two columns by corresponding thereto. In addition, a penetration space (not illustrated) which is formed by removing the sealing plate 33 in the plate thickness direction is formed in a region between the piezoelectric accommodating space 36 on one side and the piezoelectric accommodating space 36 on the other side. The flexible cable is inserted into the penetration space, and the lower electrode layer and the higher electrode layer are connected to the flexible cable.

In the recording head 3 which is configured in this manner, ink from the ink cartridge 7 is taken into the pressure chamber 30 through a liquid flow path such as the reservoir 18, the common liquid chamber 25, the supply port 26, and the like. In addition, a pressure change is caused in the pressure chamber 30 by driving the piezoelectric element 32, by supplying a driving signal from the control unit to the piezoelectric element 32, and ink droplets are ejected from the nozzle 22 through the communicating hole 27 using the pressure change.

Subsequently, a configuration of the above described communicating hole 27 will be described in detail. The communicating hole 27 according to the embodiment is formed on the pressure chamber 30 side, as illustrated in FIGS. 4 and 5, and includes a first space 38 which is formed on the pressure chamber 30 side, and directly communicates with the pressure chamber 30, and a second space 39 which is formed on the nozzle 22 side, and directly communicates with the nozzle 22. In addition, the second space 39 includes a first small space 40 which is formed on the pressure chamber 30 side, and communicates with the first space 38, and a second small space 41 which is formed on the nozzle 22 side, and directly communicates with the nozzle 22.

The first spaces 38 are linearly provided in parallel along the arranging direction of the pressure chamber 30 by corresponding to the column of the pressure chamber 30, as illustrated in FIG. 3. That is, both ends of each first space 38 in the second direction Y are formed by being aligned at a predetermined position in the direction Y. A dimension of the first space 38 in the second direction Y is formed so as to be larger than a dimension of the second space 39 in the second direction Y, as illustrated in FIG. 4. It is possible to increase a volume of the communicating hole 27, and to secure a liquid volume using the first space 38. In addition, an end on one side (side opposite to supply port 26) of the first space 38 in the second direction Y according to the embodiment is aligned at the same position as an end of the pressure chamber 30 on the same side. Specifically, the pressure chamber 30 and the first space 38 communicate with each other without forming a level difference between a lower end on a side face of the pressure chamber 30 which is inclined downward and a side face of the first space 38. In this manner, it is possible to make ink smoothly flow toward the communicating hole 27 from the pressure chamber 30. In this point, for example, when the end on one side of the first space in the second direction Y is formed inside compared to the end on the same side of the pressure chamber 30, in other words, when the communicating hole is open in the inside compared to the communicating hole of the pressure chamber, a space on the outer side of the communicating hole of the pressure chamber becomes a so-called dead end with respect to a flow of ink, and there is a concern that air bubbles may stagnate. In contrast to this, in the configuration according to the embodiment, it is possible to suppress such a problem. In addition, since it is possible to use the pressure chamber 30 up to the end on one side as a space in which effective pressure is generated, ejecting efficiency of ink is improved, compared to the above case in which the dead end is formed. In addition, it is also possible to form the end on one side (side opposite to supply port 26 side) of the first space in the second direction Y at a position which is the outside of the pressure chamber from the end on the same side of the pressure chamber. Also in this case, it is possible to suppress stagnation of air bubbles, and to improve ejecting efficiency of ink since a space which becomes the dead end is not formed in the pressure chamber.

As illustrated in FIG. 4, a dimension of the second space 39 in the second direction Y (first small space 40 and second small space 41) is formed so as to be smaller than a dimension of the first space 38 in the second direction Y. In addition, as illustrated in FIGS. 3 and 4, positions in the second direction Y of the second spaces 39 of the communicating hole 27 which are adjacent to each other in the first direction X are formed so as to be different by corresponding to the nozzles 22. Specifically, one second space 39 which communicates with the first space 38 on one side (left side in FIG. 3) in the second direction Y, and one second space 39 which communicates with the first space on the other side (right side in FIG. 3) are alternately arranged along the first direction X. According to the embodiment, as illustrated in FIG. 4, positions in the second direction Y of a side wall on one side of the second space 39 in the second direction Y which communicates with the first space on one side and a side wall of the first space 38 on the same side are aligned. For this reason, a level difference is formed between a side wall on the other side of the second space 39 in the second direction Y which communicates with the first space on one side and the side wall of the first space 38 on the same side. In addition, positions in the second direction Y of a side wall on the other side of the second space 39 in the second direction Y which communicates with the first space on the other side and the side wall of the first space 38 on the same side are aligned. For this reason, a level difference is formed between a side wall on one side of the second space 39 in the second direction Y which communicates with the first space on the other side and the side wall of the first space 38 on the same side.

In addition, it is also possible to arrange the side wall on one side of the second space 39 in the second direction Y which communicates with the first space on one side in the inside compared to the side wall of the first space 38 on the same side. Similarly, it is also possible to arrange the side wall on the other side of the second space 39 in the second direction Y which communicates with the first space on the other side in the inside compared to the side wall of the first space 38 on the same side. In these cases, level differences are formed on both side walls in the second direction Y at a boundary between the second space 39 and the first space 38. For this reason, it is preferable to provide a side wall on one side in the second direction Y at the boundary between the second space 39 and the first space 38 as in the embodiment from a point of view of smoothly flowing ink in the communicating hole 27.

As illustrated in FIG. 5, in the first small space 40 which is a higher portion of the second space 39, a dimension W3 in the first direction X is formed so as to be approximately the same dimension as a dimension of the first space 38 in the first direction X, and is formed so as to be smaller than a dimension W1 of the pressure chamber 30 in the first direction X. In this manner, it is possible to increase the rigidity of a partitioning wall Wx between communicating holes 27 which are adjacent to each other in the first direction X, and to suppress a phenomenon in which ejecting of ink, or the like, from the nozzle 22 has an influence on ejecting of ink from a nozzle 22 which is adjacent thereto through the partitioning wall Wx, that is, so-called crosstalk. In addition, in the second small space 41 which is a lower portion of the second space 39, a dimension W2 in the first direction X is formed so as to be smaller than the dimension W1 of the pressure chamber 30 in first direction X, and larger than the dimension W3 of the first small space 40 in the first direction X. In addition, a dimension of the second small space 41 in the second direction Y is formed so as to be approximately the same as a dimension of the first small space 40 in the second direction Y. In addition, a dimension H2 (that is, height) of the second small space 41 in a direction Z which is orthogonal to the nozzle substrate 21 is formed so as to be smaller than a dimension H1 of the first small space 40 in the direction Z which is orthogonal to the nozzle substrate 21. In this manner, it is possible to reduce a flow path resistance in the vicinity of the nozzle 22 in the communicating hole 27 while securing the rigidity of the partitioning wall Wx. That is, since a flow path area (sectional area) which is narrowed using the first small space 40 of the second space 39 compared to the first space 38 is widened using the second small space 41, it is possible to reduce the flow path resistance in the vicinity of the nozzle 22. As a result, it is possible to suppress variation in ejecting direction of ink droplets which are ejected from the nozzle 22.

In addition, side walls around the communicating hole 27 (that is, first space 38, first small space 40, and second small space 41) (in other words, inner faces of partitioning walls on four sides which partition communicating hole 27) are extended along the vertical direction Z (direction orthogonal to nozzle substrate 21, or ejecting direction of ink). Particularly, as illustrated in FIG. 4, since inner faces on both side walls of the second space 39 in the second direction Y are orthogonal to the nozzle substrate 21, it is possible to suppress stagnation of air bubbles in the second space 39 even when the nozzle 22 is open at any portion in the second space 39 in the second direction Y. For this reason, it is possible to secure a degree of freedom in arranging of the nozzle 22. In contrast to this, for example, in a case in which any one of side walls of the second space 39 in the second direction Y is inclined so that a flow path area (sectional area) is widened, when a nozzle is arranged so as to be close to the inclined side wall, air bubbles tend to stagnate in the second space. That is, when the side wall of the second space is inclined, portions at which nozzles are arranged are limited in a point of view of suppressing stagnation of air bubbles; however, according to the embodiment, it is possible to remove such a limitation.

In addition, since there is no limitation which is described above, as illustrated in FIGS. 3 and 4, the nozzle 22 according to the embodiment is arranged by being shifted to the side wall side on the side opposite to the side of the nozzles 22 which are adjacent to each other in the first direction X, in the second direction Y with respect to the second space 39. That is, the nozzle 22 which communicates with the second space 39 which is shifted to one side in the second direction Y with respect to the first space 38 is arranged by being shifted to the same side from the center of the second space 39. A nozzle 22 which is adjacent to the nozzle 22 in the first direction X is arranged by being shifted to the same side from the center of the second space 39 which is shifted to the other side in the second direction Y with respect to the first space 38. By arranging a nozzle 22 in this manner, it is possible to secure a distance between nozzles 22 which are adjacent to each other in the first direction X as long as possible. As a result, it is possible to further suppress the occurrence of wind ripple. In addition, the communicating hole 27 according to the embodiment (that is, first space 38, first small space 40, and second small space 41) are formed in a rectangular shape in a planar view, as illustrated in FIG. 3; however, for example, it may be formed as a parallelogram of which both side faces in the second direction Y are inclined in a planar view according to a shape of the pressure chamber. In this case, an apex on the outermost side becomes an end.

In addition, it is possible to make the recording head 3 small by configuring the recording head 3 as described above. That is, since both ends of each of the pressure chambers 30 in the second direction Y are aligned at a predetermined position, it is possible to make the substrate 29 of the pressure chamber 30 small. In addition, since the supply port 26 is formed at a position separated from the communicating hole 27 of the flow path substrate 24 which is stacked on the pressure chamber substrate without being formed on the pressure chamber substrate 29, it is possible to further reduce the size of the pressure chamber substrate 29. In this manner, it is possible to make the recording head 3 small. In addition, since positions of nozzles 22 which are adjacent to each other are set to be different in the second direction Y, it is possible to suppress the occurrence of wind ripple. In addition, since a position of at least part of communicating holes 27 which are adjacent to each other are set to be different in the second direction Y, it is possible to suppress crosstalk.

In particular, according to the embodiment, since the communicating hole 27 includes the first space 38 and the second space 39, both ends of each of the first spaces 38 in the second direction Y are aligned at a predetermined position in the second direction Y, and positions of the second spaces 39 in the second direction Y which are adjacent to each other in the first direction X are set to be different from each other, it is possible to secure a liquid volume of the communicating hole 27 using the first space 38 while suppressing crosstalk. That is, since the first space 38 has a common shape in each communicating hole 27, it is possible to widen a width thereof in the second direction Y, and to secure a necessary liquid volume. Meanwhile, since positions in the second direction Y of the second spaces 39 which are adjacent to each other are shifted, it is possible to increase the rigidity of the partitioning wall Wx which partitions second spaces 39 which are adjacent to each other, and to suppress crosstalk. In addition, the end on one side of the first space 38 in the second direction Y is formed at the same position as the end on the same side of the pressure chamber 30, or a position which is the outside of the pressure chamber 30 from the end of the pressure chamber 30, it is possible to make ink smoothly flow toward the communicating hole 27 from the pressure chamber 30, and to suppress stagnation of air bubbles. In addition, since it is possible to use the pressure chamber 30 up to the end on one side as a space in which effective pressure is generated, ejecting efficiency of ink is improved.

In addition, according to the embodiment, since the second space 39 includes the first small space 40 and the second small space 41, the dimension of the first small space 40 in the first direction X is set to be smaller than the dimension of the pressure chamber 30 in the first direction X, and the dimension of the second small space 41 in the first direction X is set to be larger than the dimension of the first small space 40 in the first direction X, it is possible to prevent a flow path resistance in the vicinity of the nozzle 22 from being increased while increasing the rigidity of the partitioning wall Wx which partitions between the communicating holes 27 which are adjacent to each other. In this manner, it is possible to suppress variation in ejecting direction of liquid droplets which are ejected from the nozzle 22 while suppressing crosstalk. In addition, since the dimension of the second small space 41 in the direction Z which is orthogonal to the nozzle substrate 21 is set to be smaller than the dimension of the first small space 40 in the direction Z which is orthogonal to the nozzle substrate 21, it is possible to sufficiently secure the rigidity of the partitioning wall Wx which partitions between the communicating holes 27 which are adjacent to each other. In addition, since the nozzle 22 is arranged on the side wall on the side opposite to the side of the nozzles 22 which are adjacent to each other in the first direction X by being shifted to the side wall side, in the second direction Y with respect to the second space 39, it is possible to widen the gap between the nozzles 22 which are adjacent to each other in the first direction X, and to further suppress the occurrence of wind ripple. In addition, since both side walls of the second space 39 in the second direction Y extend in the direction Z which is orthogonal to the nozzle substrate 21, it is possible to suppress stagnation of air bubbles in the second space 39.

In addition, as described above, since the flow path substrate 24, the pressure chamber substrate 29, the nozzle substrate 21, or the like, is a silicon substrate, and in which a flow path, or the like, is formed in the inside, respectively, using etching (specifically, resist film forming process, photolithography process, etching process, or the like), it is possible to manufacture each substrate with high accuracy, and with ease. In particular, since the communicating hole 27 is formed in the flow path substrate 24 using etching, it is possible to manufacture the above described communicating hole 27 with high accuracy, and with ease.

Meanwhile, configurations of the communicating hole 27 and the nozzle 22 are not limited to the above described first embodiment. It may be any configuration when nozzles which are adjacent to each other are formed so that positions thereof in the second direction Y are different from each other, and at least part of the communicating holes which are adjacent to each other in the first direction X are formed so that positions thereof in the second direction Y are different by corresponding to the nozzles. For example, in a second embodiment which is illustrated in FIG. 6, nozzle columns are formed by being shifted by three columns, by corresponding to a pressure chamber 30 of one column.

Specifically, as illustrated in FIG. 6, nozzle columns according to the embodiment are formed at a position which is shifted to one side (left side in FIG. 6) in the second direction Y with respect to a first space 38' of a communicating hole 27', a position which is shifted to the other side (right side in FIG. 6) in the second direction Y with respect to the first space 38', and a position between these positions, and corresponding to approximately the center of the first space 38' in the second direction Y. More specifically, a nozzle 22' which is adjacent to a nozzle 22' which is shifted to one side in the second direction Y with respect to the first space 38' on one side (lower side in FIG. 6) in the first direction X is open at a position which is slightly shifted to the other side in the second direction Y from the above described nozzle 22' which is shifted to one side, and corresponds to approximately the center of the first space 38'. In addition, a nozzle 22' which is adjacent to the nozzle 22' which is open at approximately the center in the second direction Y of the first space 38' on one side in the first direction X is open at a position which is slightly shifted to the other side in the second direction Y from the above described nozzle 22' at approximately the center, and is shifted to the other side in the second direction Y with respect to the first space 38'. In addition, a nozzle 22' which is adjacent to the nozzle 22' which is shifted to the other side in the second direction Y with respect to the first space 38' is open at a position which is shifted to one side in the second direction Y from the above described nozzle 22' which is shifted to the other side, and is shifted to one side in the second direction Y with respect to the first space 38'. In this manner, three nozzles 22' of a nozzle which is shifted to one side in the second direction Y with respect to the first space 38', a nozzle which is shifted to the center, and a nozzle which is shifted to the other side are repeatedly formed in order from one side in the first direction X. In this manner, it is also possible to suppress the occurrence of wind ripple in the embodiment.

In addition, a second space 39' of the communicating hole 27' is also arranged by being shifted to one side in the second direction Y, approximately at the center, and the other side with respect to the first space 38' corresponding to the nozzle 22'. That is, a second space 39' which is shifted to one side in the second direction Y with respect to the first space 38' by corresponding to the nozzle 22' which is shifted to one side in the second direction Y with respect to the first space 38', a second space 39' which is arranged at approximately at the center in the second direction Y with respect to the first space 38' by corresponding to the nozzle 22' which is arranged approximately at the center in the second direction Y with respect to the first space 38', and a second space 39' which is shifted to the other side in the second direction Y with respect to the first space 38' by corresponding to the nozzle 22' which is shifted to the other side in the second direction Y with respect to the first space 38' are repeatedly formed along the first direction X. In this manner, it is possible to suppress crosstalk also in the embodiment. In addition, the nozzle 22' which communicates with the second space 39' which is shifted to one side in the second direction Y with respect to the first space 38' is arranged by being shifted to the same side from the center of the second space 39'. In addition, the nozzle 22' which communicates with the second space 39' which is arranged approximately at the center in the second direction Y with respect to the first space 38' is arranged at approximately the center of the second space 39'. In addition, the nozzle 22' which communicates with the second space 39' which is shifted to the other side in the second direction Y with respect to the first space 38' is arranged by being shifted to the same side from the center of the second space 39'.

In addition, the first spaces 38' of the communicating hole 27' are linearly provided in parallel along the first direction X by corresponding to a column of the pressure chamber 30, similarly to those in the first embodiment. That is, both ends of each first space 38' in the second direction Y are formed by being aligned at a predetermined position in the direction Y. In addition, since configurations other than that are the same as those in the first embodiment, descriptions thereof will be omitted.

In addition, in each of the above described embodiments, the second space 39 includes the first small space 40 and the second small space 41; however, it is not limited to this. For example, in a third embodiment which is illustrated in FIG. 7, a first space 38" and a second space 39" are formed in a flow path substrate 24"; however, the second space 39" is not divided into a first small space and a second small space, and a recessed space 43 which communicates with the second space 39" is formed in a region corresponding to the second space 39" of a nozzle substrate 21".

The recessed space 43 is formed by etching a region corresponding to the second space 39" of the nozzle substrate 21" from a higher part to a midway point in the plate thickness direction Z. In addition, the nozzle 22" is open at a portion in the recessed space 43, and in which the plate thickness of the nozzle substrate 21" becomes thin. Here, a dimension W5 of the recessed space 43 in the first direction X is formed so as to be smaller than a dimension W4 of the pressure chamber 30 in the first direction X, and larger than a dimension W6 of the first space 38" or the second space 39" in the first direction X. In addition, a dimension H4 of the recessed space 43 in a direction Z which is orthogonal to the nozzle substrate 21" is formed so as to be smaller than a dimension H3 of the second space 39" in the direction Z which is orthogonal to the nozzle substrate 21". In this manner, it is possible to reduce a flow path resistance in the vicinity of the nozzle 22" while securing the rigidity of a partitioning wall Wx' which partitions between communicating holes 27" which are adjacent to each other. As a result, it is possible to suppress variation in ejecting direction of ink droplets which are ejected from the nozzle 22" while suppressing crosstalk. In addition, a dimension of the recessed space in the second direction Y may be formed so as to be larger than a dimension of the second space in the second direction Y. For example, it may be a configuration in which the recessed space protrudes from the second space on all sides by forming the recessed space in a circle in a planar view.

In addition, also in the embodiment, both ends of the first space 38" in the second direction Y are formed by being aligned at a predetermined position in the direction. In addition, nozzles 22" which are adjacent to each other in the first direction X are formed so that positions thereof in the second direction Y are different from each other, and the second spaces 39" which are adjacent to each other in the first direction X are formed so that positions thereof in the second direction Y are different from each other by corresponding to the nozzles 22. In addition, since configurations other than that are the same as those in the above described each embodiment, descriptions thereof will be omitted.

In addition, in each of the above described embodiments, the nozzle substrate 21, the flow path substrate 24, and the pressure chamber substrate 29 are stacked in this order, and the pressure chamber 30 and the nozzle 22 communicate using the communicating hole 27; however, it is not limited to this. For example, it may be a configuration in which another substrate is interposed between the flow path substrate and the pressure chamber substrate, and a pressure chamber and a communicating hole communicate with each other through a flow path which is formed on the substrate. In addition, it may be a configuration in which another substrate is interposed between a nozzle substrate and a flow path substrate, and a communicating hole and a nozzle communicate with each other through a flow path which is formed on the substrate.

In addition, in each of the above described embodiments, the nozzle substrate 21, the flow path substrate 24, and the pressure chamber substrate 29 are configured using one silicon substrate, respectively; however, it is not limited to this. For example, it is possible to use a substrate group which is formed of a plurality of stacked substrates as a flow path substrate. Similarly, it is also possible to configure the other substrate using a plurality of stacked substrates. In addition, it is also possible to use a substrate which is formed of a material other than silicon as these substrates.

In addition, hitherto, as a liquid ejecting head, the ink jet recording head 3 which is mounted on an ink jet printer has been exemplified; however, it is also possible to apply the invention to an apparatus in which liquid other than ink is ejected. For example, it is also possible to apply the invention to a coloring material ejecting head which is used when manufacturing a color filter of a liquid crystal display, or the like, an electrode material ejecting head which is used when forming an electrode of an organic electroluminescence (EL) display, a surface light emitting display (FED), or the like, a bioorganic material ejecting head which is used when manufacturing a biochip (biotip), and the like.

REFERENCE SIGNS LIST

1 Printer
3 Recording head
14 Actuator unit
15 Flow path unit
16 Head case
17 Accommodating space
18 Reservoir
21 Nozzle substrate
22 Nozzle
24 Flow path substrate
25 Common liquid chamber
26 Supply port
27 Communicating hole
28 Compliance sheet
29 Pressure chamber substrate
30 Pressure chamber
31 Vibrating plate
32 Piezoelectric element
33 Sealing plate
36 Piezoelectric element accommodating space
38 first space
39 Second space
40 First small space
41 Second small space
43 Recessed space

The invention claimed is:

1. A liquid ejecting head comprising:

a pressure chamber substrate on which a plurality of spaces as pressure chambers are formed along a first direction;

a nozzle substrate on which a plurality of nozzles which eject liquid in the pressure chamber are formed by corresponding to the pressure chamber; and a flow path substrate on which a plurality of communicating holes which communicate with the nozzle and the pressure chamber which corresponds to the nozzle are formed between the pressure chamber substrate and the nozzle substrate, wherein both ends of each pressure chamber in a second direction which is orthogonal to the first direction are formed by being aligned at a predetermined position in the second direction, and wherein the communicating holes which are adjacent in the first direction are formed differently so that positions of the corresponding nozzles which are adjacent in the first direction are formed so that positions thereof in the second direction are different.

2. The liquid ejecting head according to claim 1, wherein a supply port from which liquid is supplied to the pressure chamber is formed on the flow path substrate.

3. The liquid ejecting head according to claim 1, wherein the communicating hole includes a first space which is formed on the pressure chamber side, and a second space which is formed on the nozzle side, wherein both ends of each first space in the second direction are formed by being aligned at predetermined positions in the second direction, and wherein the second spaces which are adjacent in the first direction are formed so that positions in the second direction are different.

4. The liquid ejecting head according to claim 3, wherein an end on one side of the first space in the second direction is formed at the same position as an end on the same side of the pressure chamber, or an outward position of the pressure chamber from an end of the pressure chamber.

5. The liquid ejecting head according to claim 3, wherein the second space includes a first small space which is formed on the pressure chamber side, and a second small space which is formed on the nozzle side, wherein a dimension of the first small space in the first direction is smaller than a dimension of the pressure chamber in the first direction, and wherein a dimension of the second small space in the first direction is larger than the dimension of the first small space in the first direction.

6. The liquid ejecting head according to claim 5, wherein a dimension of the second small space in a direction orthogonal to the nozzle substrate is smaller than a dimension of the first small space in the direction orthogonal to the nozzle substrate.

7. The liquid ejecting head according to claim 3, wherein a recessed space which communicates with the second space is formed in a region corresponding to the second space of the nozzle substrate, and the nozzle is open in the recessed space, and wherein a dimension of the recessed space in the first direction is larger than the dimension of the second space in the first direction.

8. The liquid ejecting head according to claim 3, wherein both side walls of the second space in the second direction extend in a direction orthogonal to the nozzle substrate, and wherein the nozzle is arranged by being shifted to a side wall side in the second direction on a side opposite to a side of the nozzles which are adjacent in the first direction with respect to the second space.

9. The liquid ejecting head according to claim 1, wherein the flow path substrate is a silicon substrate, and the communicating hole is formed on the flow path substrate using etching.

* * * * *